United States Patent [19]

Frohbieter et al.

[11] Patent Number: 4,660,247

[45] Date of Patent: Apr. 28, 1987

[54] TEMPERATURE LIMITING SYSTEM FOR A SPRING LOADED TORQUE LIMITING CLUTCH

[75] Inventors: Edwin H. Frohbieter; William J. Linstromberg, both of Lincoln Township, Berrien County, Mich.

[73] Assignee: Whirlpool Corporation, Benton Harbor, Mich.

[21] Appl. No.: 815,391

[22] Filed: Dec. 31, 1985

[51] Int. Cl.[4] ..... A47L 9/04

[52] U.S. Cl. ..... 15/339; 15/390; 192/30 W; 192/56 R

[58] Field of Search ..... 15/339, 390; 192/30 W, 192/56 R, 82 T

[56] References Cited

U.S. PATENT DOCUMENTS

| | | | |
|---|---|---|---|
| 2,539,534 | 1/1951 | Eckhardt | 192/30 W |
| 4,099,291 | 7/1978 | Bowerman | 15/390 |
| 4,168,564 | 9/1979 | Grabovez | 15/377 |
| 4,271,947 | 6/1981 | Gaeckle | 192/56 R X |
| 4,317,253 | 3/1982 | Gut et al. | 192/56 R X |

FOREIGN PATENT DOCUMENTS

| | | | |
|---|---|---|---|
| 3204272 | 8/1983 | Fed. Rep. of Germany | 15/390 |

*Primary Examiner*—Chris K. Moore

*Attorney, Agent, or Firm*—Hill, Van Santen, Steadman & Simpson

[57] ABSTRACT

A temperature responsive fuse is provided for use in a vacuum cleaner brush dowel drive clutch mechanism to prevent overheating of the clutch mechanism upon a continued rotation of the drive belt after the brush dowel has stalled due to jamming or similar occurances. The friction clutch is provided to prevent damage to the cog drive belt if the brush dowel becomes stalled and the fuse, which is a meltable spacer positioned between a loading spring and the engaging friction drive surfaces, is provided to prevent excessive heat build-up in the clutch mechanism in case a safety circuit, which normally detects stoppage of the brush dowel and deenergizes the dowel drive motor, should fail. The fuse spacer will melt at a temperature in the range of 300° F. to 400° F. to unload the spring thereby reducing friction between the engaging surfaces of the clutch mechanism and thus lowering the amount of heat generated.

11 Claims, 5 Drawing Figures

TEMPERATURE LIMITING SYSTEM FOR A SPRING LOADED TORQUE LIMITING CLUTCH

BACKGROUND OF THE INVENTION

1. Field of the Invention

The present invention relates to torque limiting clutches and in particular to a temperature sensitive device for limiting the torque applied to the clutch.

2. Description of the Prior Art

The present invention is used in an upright vacuum sweeper which has a floor engagable brush dowel rotatably driven by a cog belt which engages a sprocket carried on the brush dowel. If the brush dowel becomes jammed such as by engagement with a sock or other article, a clutch mechanism permits the sprocket to slip on the brush dowel to prevent damage to the cog belt. The vacuum sweeper includes a control circuit such as that disclosed in U.S. Pat. No. 4,370,690 to terminate operation of the motor driving the brush dowel in the event the sensed speed of the brush drops below a predetermined low speed.

However, if the control circuit were to fail, and then the brush dowel is jammed, the motor will not turn off and the clutch will heat by friction reaching excessive temperatures. Since the brush dowel is oftentimes constructed of wood, the excessive heat will cause the wood to char and may in fact ignite.

Clutches having temperature sensitive torque limiting devices are disclosed for use in devices distinct from upright vacuum cleaners. For example, U.S. Pat. No. 4,287,975 discloses a clutch usable in an automobile which includes a meltable, fusible material between a friction lining material and its supporting structure in a drive plate and driven plate arrangement. The meltable, fusible material has a melting point such that it undergoes a transition from a solid state to a liquid state when the clutch reaches an elevated temperature, allowing the driven plate to slip with respect to the driving plate and thus preventing damage to the friction lining material. Upon cooling the assembly reforms to its original state.

U.S. Pat. No. 4,132,300 discloses the use of a solder connection between a drive shaft and an actuator assembly in a refrigerant compressor which will melt in the event the compressor becomes overheated. When the solder melts, a spring will cause the actuator assembly to move to cause keys to move out of engagement with a tapered section of a hub, releasing the driving connection and permitting free rotation of the pulley.

SUMMARY OF THE INVENTION

The the present invention provides a means for unloading the clutch system in a vacuum sweeper rotating brush dowel if the clutch reaches a predetermined temperature because of stalling or jamming of the brush dowel. A fuse spacer is positioned between a loading spring and one of the clutch plates which will melt allowing the load spring to unload as it expands into the space where the fuse spacer had been. With the spring force off of the clutch, the sprocket becomes a free wheeling idler and thus the temperature rise caused by friction will dissipate.

The fuse spacer is positioned in an area such that when it melts it will flow into a gap visible from the underside of the vacuum sweeper and thus, if the fuse is provided in a color such as red, a visible indication will be provided to the user that the fuse needs to be replaced.

DESCRIPTION OF THE PREFERRED EMBODIMENTS

Figure 1:
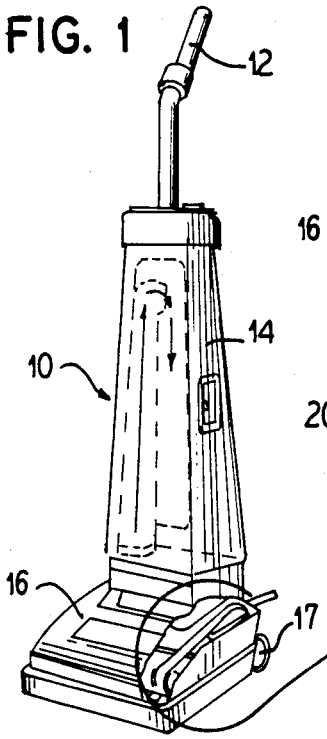
FIG. 1 is a perspective view of an upright vacuum sweeper embodying the principles of the present invention.

In FIG. 1 there is illustrated an upright vacuum sweeper or cleaner generally at 10 which includes at a top end a handle 12 to permit the user to manipulate the sweeper over a floor area to be cleaned. A dirt collecting compartment 14 is carried by the sweeper below the handle 12, but above a floor engaging portion or housing 16. A floor engaging housing 16 has a plurality of wheels 17 permitting the housing 16 to be rolled over a floor surface to be cleaned.

Figure 2:
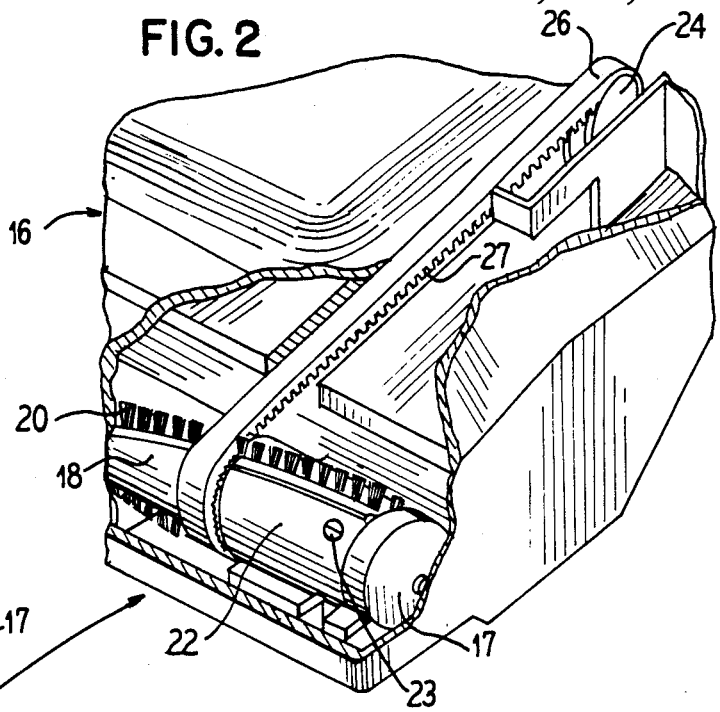
FIG. 2 is an enlarged partial perspective view, of the brush dowel and drive portion of the vacuum sweeper as indicated from FIG. 1.

A part of the floor engaging portion 16 is shown in greater detail in FIG. 2 which has been partially cut away to show a brush dowel 18 having helically arranged rows of bristles 20 for engaging the floor surface to be cleaned. An end portion 22 of the brush dowel is removable from the main portion of the brush dowel by removal of a locking screw 23 to assemble and maintain a clutch mechanism on the brush dowel. An electric motor (not visible) drives a drive pulley 24 which in turn drives a cog tooth belt 26. The cog belt 26 has a plurality of spaced teeth 27 on an inner surface thereof and engages with a driving pulley or sprocket 28 having external ridges 29 for meshing with the teeth 37 and which is carried on the brush dowel 18 between the main brush dowel portion and the removable end portion 22.

Figure 3:
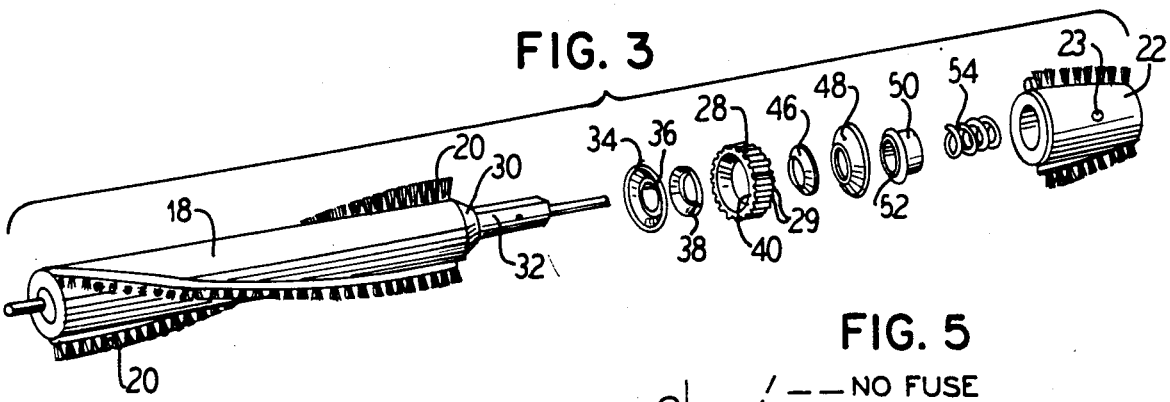
FIG. 3 is an exploded view of the brush dowel and clutch mechanism.
Figure 4:
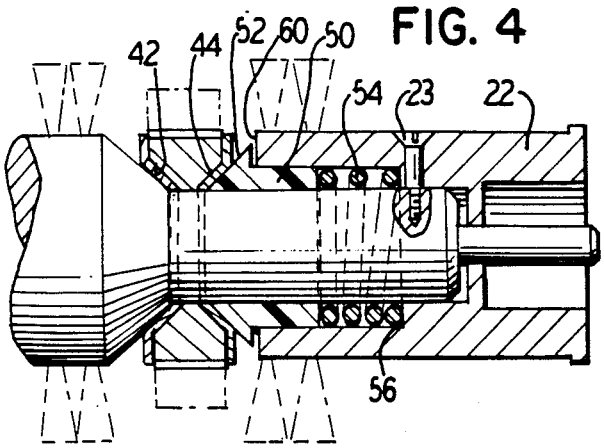
FIG. 4 is a partial sectional assembled view of the brush dowel and clutch mechanism.

The clutch arrangement is best illustrated in FIGS. 3 and 4 where it is seen that the brush dowel 18 has a bevelled end portion 30 which reduces the diameter of the dowel down to a smaller shaft area 32. A first cone washer 34 is provided which has a central opening 36 sized to be received on the shaft portion 32 and is formed at an angle to engage the bevelled surface 30 of the brush dowel. A friction clutch facing member 38 is next provided to ride on the exterior surface of the cone washer 34. It has been determined that an appropriate material for the clutch facing 38 is Rulon. The sprocket 28 is the next element to slip over the shaft 32. The sprocket has a double bevelled internal opening 40 with a first bevelled surface 42 to engage with the clutch facing member 38. A second bevelled surface 44 is engaged by a second clutch facing member 46 which preferably is also constructed of Rulon. A second cone washer 48 is provided to engage against the second clutch facing 46. A temperature sensitive fuse 50 is next provided to be received on the shaft 32. The fuse 50 which preferably is constructed of polypropylene has a melting temperature in the 300°–400° F. range. As seen in FIG. 4, one end of the fuse 50 has a cone shape surface 52 to engage with the cone washer 48. It has been found that the use of cone or bevel shapes provides a self-centering function for all of the elements of the clutch mechanism thereby reducing critical tolerances and increasing the effectiveness and reliability of the clutch.

The next element to be received on the shaft 32 is a load spring 54 which engages the fuse 50 at one end and, when the end piece 22 of the brush dowel is inserted onto the shaft area 32 of the brush dowel and held in place by the locking screw 23, the spring 54 is compressed between the fuse 50 and an inside wall 56 of the end piece 22. The spring provides sufficient force to result in frictional engagement of all of the elements carried on the shaft portion 32 of the brush dowel 18 up to a predetermined torque level. If the brush dowel is prevented from rotating, such as by a jam due to a sock or other article being engaged by the rotating brush dowel, the clutch assembly will slip at some point between the elements of the clutch assembly to prevent damage to the cog belt 26.

The control circuitry for the vacuum sweeper 10 includes a control circuit to terminate operation of the motor in the event the sensed speed of the brush dowel drops below a predetermined low speed which would indicate a jamming of the brush. The control circuit does not operate quickly enough to prevent damage to the teeth of the cog belt 26 and that is why the slip clutch arrangement is provided. The control circuit will terminate operation of the motor prior to excessive heat build-up due to friction in the clutch mechanism once the brush dowel has become jammed.

Figure 5:
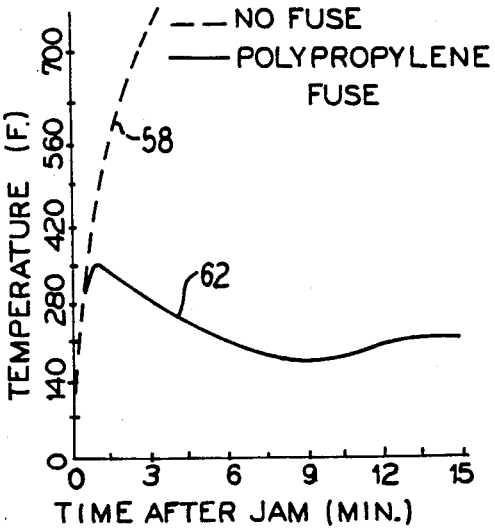
FIG. 5 is a graph illustrating the temperature of the clutch area of a jammed brush dowel with and without the unloading fuse.

However, if there is a failure in the control circuit and operation of the motor is not terminated when the brush dowel is jammed, then the temperature of the clutch elements will quickly elevate to a potentially dangerous level as is illustrated in FIG. 5. Dashed line 58 represents the temperature rise over time of the clutch mechanism when the frictional slippage continues to occur under the load of the spring 54 after the brush dowel has been prevented from rotating. Since the brush dowel is generally fabricated of wood or other combustible material, it is seen that the temperature rise quickly passes into a range which will cause charring or combustion of the brush dowel. Therefore, the temperature sensitive fuse 50 is placed between the loading spring 54 and the second cone washer 48. The melting temperature of the fuse is selected to be in the range of 300°–400° F. and thus, when the temperature of the clutch elements achieves that level, the fuse 50 will begin to melt and flow away from the spring 54, the spring then expanding toward the second cone washer 48 dropping its load as it expands toward free length. The fuse material will flow out through a space 60 between the end piece 22 of the brush dowel and the second cone washer 48 and will thus be visible to a person looking at the brush dowel from the underside of the vacuum sweeper. Therefore, the fuse material can be provided in a bright color such as red to give a visual indication that the fuse has melted and needs replacement.

A solid line 62 in the graph of FIG. 5 illustrates the temperature reduction of the clutch elements due to the melting of the fuse 50 and thus relaxation of the spring 54. Once the spring 54 has relaxed, the sprocket 28 will become essentially a free wheeling idler thus removing over temperature danger.

As is apparent from the foregoing specification, the invention is susceptible of being embodied with various alterations and modifications which may differ particularly from those that have been described in the preceeding specification and description. It should be understood that we wish to embody within the scope of the patent warranted hereon all such modifications as reasonably and properly come within the scope of our contribution to the art.

We claim as our invention:

1. In a vacuum cleaner, the combination comprising:

a brush dowel rotatably mounted to engage a floor surface to be cleaned;

an electric drive motor with an output shaft drivingly engagable with said brush dowel to rotate said brush dowel;

a drive belt connecting said output shaft and said brush dowel providing said driving engagement;

a clutch mechanism on said brush dowel between said brush dowel and said drive belt to prevent damage to said drive belt if said brush dowel is restrained against rotation;

said clutch mechanism including a loading spring;

a plurality of engaging surfaces having a sufficiently large friction therebetween when pressed into engagement by said loading spring to transmit sufficient torque from said drive belt to said brush dowel to cause said dowel to rotate against said floor surface, said engaging surfaces having a sufficiently small friction therebetween to cause slippage therebetween when said dowel is held against rotation while said drive belt continues to rotate, and a fuse spacer positioned between said spring and said engaging surfaces, said fuse spacer having a melting temperature in the range of 300° F. to 400° F.;

whereby, said fuse spacer will melt and release the spring force of said spring upon continued slippage between said engaging surfaces to prevent an undesirable temperature build up in said clutch mechanism.

2. A device according to claim 1, wherein said fuse spacer is positioned adjacent a gap between said spring and said engaging surfaces such that when said spacer melts it will flow into said gap to provide a visual indication to users of said device that the fuse needs to be replaced.

3. A device according to claim 2, wherein said fuse spacer is fabricated of a distinctly colored material to enhance the visibility of the material upon its flowing into said gap.

4. A device according to claim 1 including a pulley member carried on said brush dowel to be drivingly engaged by said drive belt and said engaging surfaces being positioned between said pulley member and said brush dowel.

5. A device according to claim 4, wherein said drive belt comprises a cog drive having teeth and said pulley comprises a sprocket with ridges for meshing with said drive belt teeth.

6. A device according to claim 4 including a plurality of washers and friction facing members carried on said brush dowel and engagable with said pulley to provide said engaging surfaces.

7. A device according to claim 6, wherein said engaging parts including said dowel, said washers, said friction facings, said pulley and said fuse spacer have beveled engaging surfaces such that said engaging parts are self-centered with respect to each other.

8. A device according to claim 7, wherein said loading spring is a coil spring carried on said brush dowel.

9. In a vacuum cleaner a floor engaging brushing apparatus comprising:

a wheeled floor engaging housing for rolling over a floor surface to be cleaned;

an electric motor mounted in said housing and having an extending drive shaft with a sprocket-type driven pulley thereon;

a brush dowel rotatably mounted in said housing;

a sprocket member carried on said brush dowel;

a cog drive belt mounted on said sprocket-type drive pulley and said sprocket member to transmit a drive torque from said motor to said sprocket member;

a clutch mechanism positioned between said sprocket member and said brush dowel to transmit said drive torque from said sprocket member to said brush dowel;

said brush dowel having a removable end piece carried on a reduced diameter shaft portion of said brush dowel, said brush dowel having a beveled surface providing a transition to said reduced diameter shaft;

said clutch mechanism comprising a first cone washer having a central opening for being received on said shaft portion and being engagable against said beveled surface;

a first friction facing member engagable against said first cone washer and said sprocket member;

said sprocket member having a central opening for being received on said shaft portion and defining a pair of beveled surfaces, a first of said surfaces engagable with said first friction facing material to urge said material against said cone washer;

a second friction facing material engagable with a second of said beveled surfaces;

a second cone washer having a central opening for being received on said shaft portion and being engagable with said second friction facing material;

a fuse spacer member fabricated of a material with a melting temperature in the range of 300° to 400° F. having a central opening for being received on said shaft portion and having a first beveled end for engaging said second cone washer to urge said cone washer against said second facing material;

a coil type load spring carried on said shaft portion having a first end engagable against said fuse spacer member;

said removable end piece of said brush dowel having an opening for being received on said shaft portion with an end wall for engaging and pressing against said spring to load said spring;

said removable end piece being removably retained on said shaft member by means of a locking fastener;

said friction facings, cone washers and sprocket having a sufficiently large friction therebetween when pressed into engagement by said load spring to transmit sufficient torque from said sprocket member to said brush dowel to cause said brush dowel to rotate against said floor surface, said friction facings, cone washers and sprockets having a sufficiently small friction therebetween to cause slippage therebetween when said dowel is held against rotation while said drive belt continues to rotate;

whereby, said fuse spacer will melt and release said load from said spring upon said slippage causing a rise in temperature of said clutch mechanism to a level above said melting temperature of said fuse to prevent a temperature rise in said clutch mechanism appreciably above said melting temperature.

10. An apparatus according to claim 9, wherein said fuse spacer is positioned adjacent a gap between said second cone washer and said removable dowel end piece such that when said spacer melts it will flow into said gap to provide a visual indication to users of said apparatus that said fuse needs to be replaced.

11. A device according to claim 10, wherein said fuse spacer is fabricated of a distinctly colored material to enhance the visibility of the material upon its flowing into said gap.

* * * * *